US007556103B2

(12) United States Patent
Matsunaga

(10) Patent No.: US 7,556,103 B2
(45) Date of Patent: Jul. 7, 2009

(54) TIGHTENING TOOL AND TIGHTENING TOOL MANAGEMENT SYSTEM

(75) Inventor: Yutaka Matsunaga, Anjo (JP)

(73) Assignee: Makita Corporation, Anjo-shi, Aichi (JP)

( * ) Notice: Subject to any disclaimer, the term of this patent is extended or adjusted under 35 U.S.C. 154(b) by 354 days.

(21) Appl. No.: 10/598,705

(22) PCT Filed: Mar. 10, 2005

(86) PCT No.: PCT/JP2005/004226

§ 371 (c)(1),
(2), (4) Date: Sep. 8, 2006

(87) PCT Pub. No.: WO2005/087441

PCT Pub. Date: Sep. 22, 2005

(65) Prior Publication Data

US 2008/0230245 A1 Sep. 25, 2008

(30) Foreign Application Priority Data

Mar. 12, 2004 (JP) ..... 2004-070547

(51) Int. Cl.
*B25B 23/14* (2006.01)

(52) U.S. Cl. ..... 173/2; 173/176; 173/178; 173/181; 173/183; 702/33; 702/182; 73/862.23

(58) Field of Classification Search ..... 172/2, 172/4, 176, 178, 181, 183, 217; 81/467, 81/470; 73/379.01, 862.23; 702/33, 41, 702/114, 182; 700/168; 320/107, 114; 318/432, 318/490; 340/680; 388/909, 838
See application file for complete search history.

(56) References Cited

U.S. PATENT DOCUMENTS 4,536,688 A * 8/1985 Roger ..... 318/490
5,154,242 A * 10/1992 Soshin et al. ..... 173/178
5,203,242 A * 4/1993 Hansson ..... 81/469

(Continued)

FOREIGN PATENT DOCUMENTS

JP 61-50777 A 3/1986

(Continued)

*Primary Examiner*—Scott A. Smith
(74) *Attorney, Agent, or Firm*—Orrick Herrington & Sutcliffe LLP

(57) ABSTRACT

A fastening tool with a clutch for shutting off transmission of torque, capable of self-diagnosing fastening torque of a screw or the like at low cost without using expensive elements such as a torque sensor, etc. A fastening tool (10) has a motor (13), a main shaft (20) engaging with a screw or the like, and a clutch (14) interposed between the motor (13) and the main shaft (20). The clutch (14) transmits torque from the motor (13) to the main shaft (20) when a load acting on the main shaft (20) is less than a predetermined value, and shuts off torque transmission from the motor (13) to the main shaft (20) when a load acting on the main shaft (20) is equal to or greater than the predetermined value. The fastening tool (10) further has a control unit (60) for controlling the motor (13). The control unit (60) monitors a current flowing to the motor (13) and determines whether fastening torque is normal or not based on a motor current when transmission of torque from the motor (13) to the main shaft (20) is shut off.

18 Claims, 10 Drawing Sheets

U.S. PATENT DOCUMENTS 5,245,747 A * 9/1993 Hansson ..... 29/703
5,637,968 A * 6/1997 Kainec et al. ..... 318/432
5,715,894 A * 2/1998 Maruyama et al. ..... 173/180
5,903,462 A * 5/1999 Wagner et al. ..... 700/168
5,918,201 A * 6/1999 Szwast et al. ..... 702/182
6,161,629 A * 12/2000 Hohmann et al. ..... 173/181
6,191,554 B1 * 2/2001 Nakane et al. ..... 320/114
6,349,266 B1 * 2/2002 Lysaght et al. ..... 702/41
6,371,218 B1 * 4/2002 Amano et al. ..... 173/183
6,394,221 B2 * 5/2002 Cosma ..... 181/113
6,516,896 B1 * 2/2003 Bookshar et al. ..... 173/1
6,598,684 B2 * 7/2003 Watanabe ..... 173/2
6,607,041 B2 8/2003 Suzuki et al.
6,983,809 B2 * 1/2006 Leitenberger et al. ..... 173/176
7,419,013 B2 * 9/2008 Sainomoto et al. ..... 173/181

FOREIGN PATENT DOCUMENTS

JP 2-30443 A 1/1990
JP 6-254775 A 9/1994
JP 6-312381 A 11/1994
JP 08-118251 A 5/1996
JP 11-179673 A 7/1999
JP 2000-015586 A 1/2000
JP 2001-088046 A 4/2001
JP 2001-179646 A 7/2001
JP 2002-18744 A 1/2002
JP 2002-233968 A 8/2002
JP 2003-053678 A 2/2003

* cited by examiner (a) Hard Joint (b) Soft Joint

TIGHTENING TOOL AND TIGHTENING TOOL MANAGEMENT SYSTEM

TECHNICAL FIELD

The present invention relates to a tightening tool for tightening a fastener (for example, a bolt, a nut, a screw, and so on), and more particularly to a tightening tool having a clutch which shuts off torque transmission to the fastener when a tightening torque reaches a preset value.

BACKGROUND ART

Japanese Patent Application Publication No. 11-179673 discloses a tightening tool for shutting off torque transmission to a fastener when the tightening torque of the fastener reaches a predetermined value. In this tightening tool, the rotary torque of a motor is transmitted to a main shaft via a clutch, and the fastener is tightened by rotating the main shaft. The clutch used in this type of tightening tool comprises a pair of mutually opposed clutch members and biasing means (e.g., a spring) for pressing one of the clutch members toward the other, for example. When the tightening torque of the fastener (i.e. the load acting on the main shaft) is lower than the predetermined value, the clutch members are maintained in an engaged state such that the torque of the motor is transmitted to the main shaft. On the other hand, when the tightening torque of the fastener reaches or exceeds the predetermined value, the state of engagement between the clutch members is released, and torque transmission from the motor to the main shaft is shut off.

DISCLOSURE OF THE INVENTION

In the tightening tool described above, the torque of the motor is transmitted to the main shaft by the mechanical engagement between the clutch members. Therefore, the load applied by the clutch (i.e. the load when torque transmission is shut off) decreases over time due to wear of the clutch members, causing variation in the tightening torque of the fastener. Hence, conventionally the tightening torque of the fastener is actually measured at the beginning of the tightening operation period, and an adjustment is performed such that the tightening torque of the fastener corresponds to the predetermined value. Next, the tightening torque of the fastener is actually measured again at the end of the operation period, and thus a check is performed to determine whether or not the tightening operations from the beginning of the operation period to the end of the operation period have been performed appropriately.

However, with this method, if the tightening torque deviates from the predetermined value during the operation for one reason or another (for example, due to clutch damage), it is impossible to determine that the tightening torque has deviated from the predetermined value at that point in time, and the deviation only becomes known from the measurement that is performed at the end of the operation period. As a result, rechecks must be performed with respect to all of the tightening operation performed during the operation period.

Note that in some tightening tools, a torque sensor is provided on the main shaft and the tightening torque is detected upon every tightening operation. However, a torque sensor is expensive and leads to an increase in cost. Therefore, demand has arisen for a technique which enables detection of the tightening torque at a reasonable cost.

It is an object of the present invention to provide a tightening tool having a clutch for shutting off torque transmission, in which the tightening torque of a fastener can be self-diagnosed at a reasonable cost without the use of expensive means such as a torque sensor.

A tightening tool of the present invention may include a motor, a main shaft which engages with a fastener, and a clutch disposed between the motor and the main shaft. The clutch rotates the main shaft by transmitting torque from the motor to the main shaft when a load acting on the main shaft (i.e. the tightening torque of the fastener) is less than a predetermined value, and shuts off torque transmission from the motor to the main shaft when the load acting on the main shaft reaches or exceeds the predetermined value. Hence, when the tightening torque of the fastener is less than the predetermined value, the main shaft rotates and the fastener is tightened to a tightening member. On the other hand, when the tightening torque of the fastener is equal to or greater than the predetermined value, rotation of the main shaft is halted and tightening of the fastener is halted.

The clutch preferably includes a mechanical clutch mechanism. For example, the mechanical clutch mechanism may be constituted by a pair of opposing clutch plates, and biasing means (e.g., a compression spring) for pressing one of the pair of clutch plates toward the other. When the load acting on the main shaft is less than the predetermined value, the clutch plates are mechanically engaged and the torque of the motor is transmitted to the main shaft. On the other hand, when the load acting on the main shaft reaches or exceeds the predetermined value, one of the clutch plates idles relative to the other clutch plate, and hence torque transmission from the motor to the main shaft is shut off. Note that the pressing force of the biasing means is preferably adjustable. By adjusting the pressing force of the biasing means, the predetermined value at which the clutch mechanism is activated can be adjusted.

A tightening tool according to one aspect of the present invention may include current detecting means (e.g., an ammeter) for detecting a current flowing to the motor, and determining means (e.g., a microcomputer or microprocessor) for determining, when torque transmission from the motor to the main shaft has been shut off, whether or not the tightening torque of the fastener is normal from a motor current value detected by the current detecting means at the time of torque transmission shut-off. A correlation exists between the value of the current flowing to the motor and the motor load, and a correlation also exists between the motor load and the tightening torque of the fastener. Hence, by learning the value of the current flowing to the motor at the time of torque transmission shut-off, it is possible to determine from the current value whether or not the tightening torque of the fastener has reached a predetermined value. In this tightening tool, the current detecting means monitors the current flowing to the motor, and the determining means determines whether or not the tightening torque of the fastener is normal on the basis of the current value at the time of torque transmission shut-off.

The tightening tool may further include clutch activation detecting means (e.g., a sensor such as a contact or non-contact switch) for detecting that the clutch has shut off torque transmission. In this case, the determining means (e.g., a microcomputer or the like) may be connected to the clutch activation detecting means and the current detecting means, and may determine whether or not the tightening torque of the fastener is normal on the basis of signals from these means. For example, having determined that the clutch has been activated on the basis of the output from the clutch activation detecting means, the determining means obtains the value of the current flowing to the motor from the output of the current detecting means. Then, when the obtained current value is within a preset range (e.g., equal to or greater than a preset current value), the determining means determines that the tightening torque of the fastener is normal. On the other hand, when the read current value is outside of the preset range (e.g., less than the preset current value), the determining means determines that the tightening torque of the fastener is abnormal.

A tightening tool according to another aspect of the present invention may include current detecting means for detecting the current flowing to the motor, and rotation angle detecting means for detecting a rotation angle of the main shaft or the motor. This tightening tool preferably further includes determining means (for example, a microcomputer or microprocessor) for determining whether or not the tightening torque of the fastener is normal based upon the rotation angle of the main shaft or the motor detected by the rotation angle detecting means during a period extending from (1) a time at which the current value detected by the current detecting means exceeds a preset value to (2) a time at which torque transmission from the motor to the main shaft is shut off.

When the fastener is tightened to the tightening member, the tightening torque of the fastener increases gradually as the fastener is tightened, and the load acting on the motor also increases gradually. Hence, it is possible to determine whether or not the fastener has come into contact with the tightening member (whether or not the fastener is seated) by determining whether or not the motor load (i.e. the motor current) has exceeded a preset value (set appropriately in accordance with the tightening operation). Further, the rotation angle of the fastener once the fastener is seated on the tightening member correlates with the tightening torque of the fastener. Accordingly, by learning the rotation angle of the fastener once the fastener is seated, it is possible to determine whether or not the tightening torque of the fastener is normal.

Hence, the determining means of the tightening tool determines whether or not the tightening torque of the fastener is normal on the basis of the rotation angle of the fastener during a period extending from (1) the time at which the current flowing to the motor exceeds the preset value (i.e. the time at which the fastener is seated) to (2) the time at which the clutch shuts off torque transmission. More specifically, for example, the determining means (a microcomputer, microprocessor, or the like) is connected to the current detecting means and the rotation angle detecting means, and the output of these means is input into the determining means. The determining means measures the rotation angle of the main shaft (or the motor) from the time at which the current flowing to the motor exceeds the preset value to the time at which the clutch is activated. Then, when the measured rotation angle is within a preset angle range (for example, equal to or greater than a preset angle), the determining means determines that the tightening torque of the fastener is normal. On the other hand, when the measured rotation angle is outside of the preset angle range (for example, less than the preset angle), the determining means determines that the tightening torque of the fastener is abnormal.

Note that the rotation angle detecting means preferably detects the rotation angle of the main shaft since the main shaft does not rotate after torque transmission has been shut off. A rotary encoder may be used as the rotation angle detecting means. When the tightening tool includes a bearing device which supports the main shaft rotatably, for example, the rotary encoder may be provided in the bearing device.

Further, each of the tightening tools described above preferably includes means for warning an operator when the tightening torque of the fastener is determined to be abnormal by the determining means. According to this constitution, when the tightening torque of the fastener is abnormal, the operator is warned thereof, and can immediately take measures (readjusting the tightening tool, for example).

Further, the motor may employ a permanent magnet synchronous motor (for example, a brushless DC motor). A permanent magnet synchronous motor is preferable since it reduces the mechanical inertial force (inertia) of the rotor. By reducing the mechanical inertial force of the rotor, the correlative relationship between the tightening torque of the fastener and the motor current value can be enhanced.

Note that the tightening torque may be determined according to both the motor current value when torque transmission is shut off and the rotation angle of the fastener once the fastener is seated. By performing both determinations simultaneously, the precision with which the tightening torque is determined can be enhanced.

Further, each of the tightening tools described above may be used in tightening operations to tighten the fastener to different types of tightening members at a different target torque. For example, the tightening tool may be used in a tightening operation to tighten the fastener to a hard member made of iron or the like (to be referred to hereafter as a hard joint material) at a first target torque, and a tightening operation to tighten the fastener to a soft member made of wood or the like (to be referred to hereafter as a soft joint material) at a second target torque. Alternatively, the tightening tool may be used in a tightening operation to tighten the fastener to a first tightening location of the same tightening member at a third target torque, or a tightening operation to tighten the fastener to a second tightening location of the same tightening member at a fourth target torque.

When the tightening tool is used in different types of tightening operations, the tightening tool may further include a memory which stores a preset motor current range and/or a preset angle range of the main shaft rotation angle for each type of tightening operation. In this case, the preset motor current range is preferably set to a value corresponding to a preset clutch torque. The determining means (a microcomputer, microprocessor, or the like) may read a preset motor current range and/or a preset angle range of the main shaft rotation angle from the memory in accordance with the type of tightening operation, and determine the tightening torque using the read values.

The tightening operation type may be input by a user upon every operation, or the determining means may determine the tightening operation type during the tightening operation. For example, the determining means (a microcomputer, microprocessor, or the like) may determine the operation type from temporal variation in the motor current value once the fastener is seated, and read a tightening torque determination condition (the preset motor current range and/or the preset angle range of the main shaft rotation angle) corresponding to the determined operation type from the memory.

Note that an operation manager may set the preset motor current range and/or the preset angle range of the main shaft rotation angle in accordance with the tightening operation type by manipulating an external input apparatus (e.g., a personal computer) connected by wire or wirelessly to the tightening tool. Alternatively, the fastener is tightened to a torque tester or the actual tightening location approximately several tens of times using a tool which has been subjected to simple clutch adjustment in accordance with the target torque of the tightening location, and the motor current upon clutch activation during each tightening operation is stored. Then, a statistically processed value such as an average value of the stored current values may be set as the preset motor current value, a preset range (for example, within ±10% of the preset current value) may be set from the preset motor current value, and the preset range can be set as the preset motor current range.

The present invention further provides a management system for managing the tightening operation performed by the tightening tool. For example, the management system of the present invention includes a plurality of the tightening tools, and a management apparatus (for example, a personal computer) connected communicably to the tightening tools. The tightening tool includes means for communicating with the management apparatus, and determining means (a microcomputer, microprocessor, or the like) for determining whether or not the tightening torque of the fastener is normal. The management apparatus includes means for communicating with the tightening tool and a memory for storing operation management information. The communicating means of the tightening tool transmit a determination result determined by the determining means to the management apparatus. The memory of the management apparatus stores the determination result transmitted from the communicating means of the tightening tool.

In this management system, when an operation to tighten the fastener is performed, the determining means of the tightening tool determine whether or not the tightening torque of the fastener is normal for each tightening operation. The determination result generated by the determining means is then transmitted to the management apparatus and stored in the memory of the management apparatus. Hence, it is possible to determine the number of operations performed by the tightening tool and the extent of wear on the clutch from the information stored in the memory of the management apparatus, and therefore possible to determine whether or not maintenance is required.

Note that communication between the tightening tool and the management apparatus may be performed by wire or wirelessly. Further, transmission of the determination result from the tightening tool to the management apparatus may be performed upon each tightening operation, or the determination results of tightening operations performed within a fixed operation period may be transmitted together. For example, determination results may be stored successively in the tightening tool during an operation period on a production line in a factory, and once the operation period is complete, the determination results of the day may be transmitted to the management apparatus together.

Further, when transmitting the determination result to the management apparatus, the communicating means of the tightening tool may also transmit specifying information for specifying the fastener relating to the determination result (i.e. the fastener tightened by the tightening operation that is the subject of the determination result). The memory of the management apparatus preferably stores the received determination result and specifying information in association. The operation manager can then specify a fastener having an abnormal tightening torque from the specifying information stored in the memory, and take measures such as retightening the fastener smoothly.

BEST MODES FOR CARRYING OUT THE INVENTION

Figure 1:
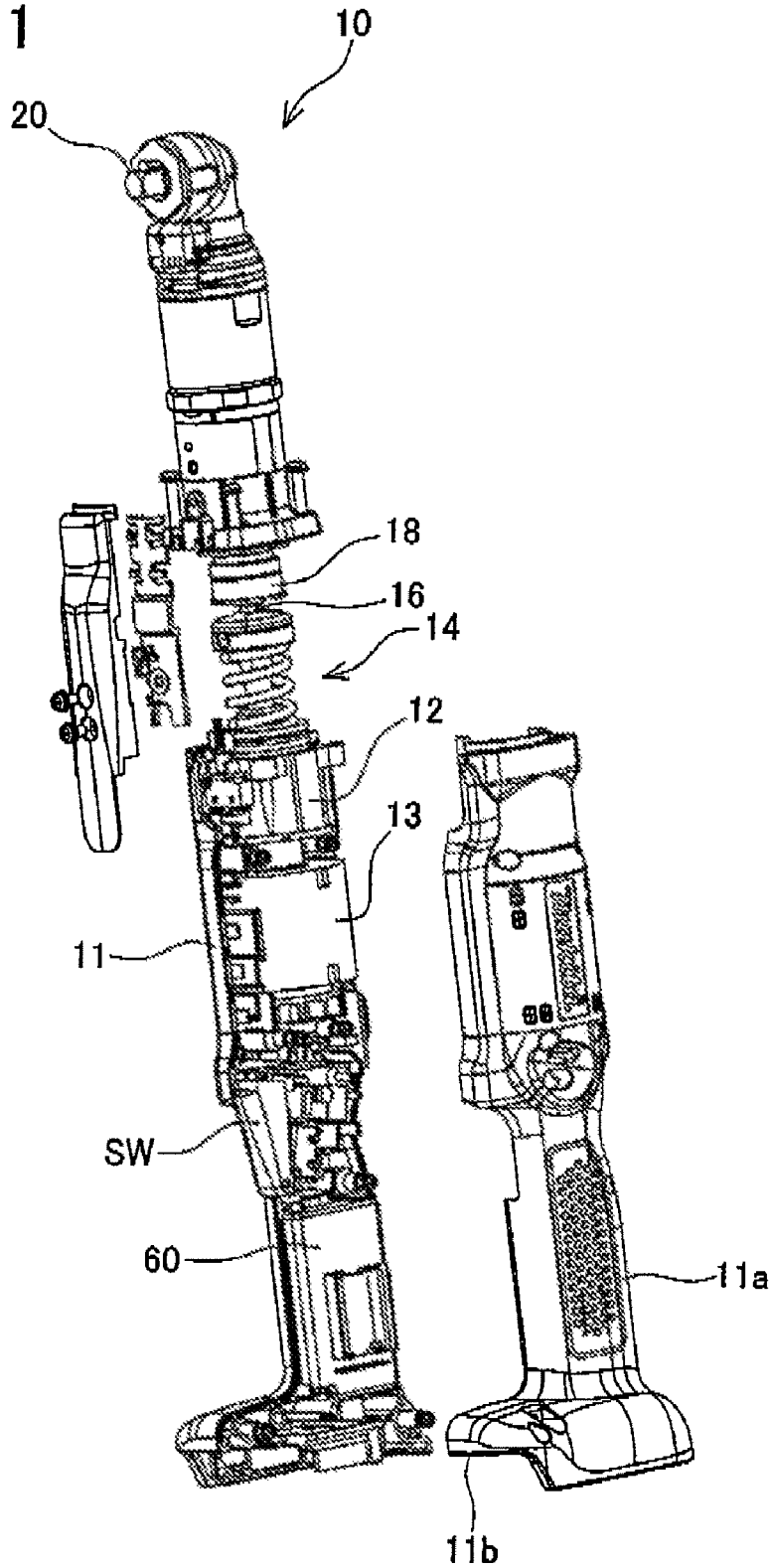
FIG. 1 is an exploded perspective view of a tightening tool according to an embodiment of the present invention.

A tightening tool according to an embodiment of the present invention will be described below. FIG. 1 is an exploded perspective view of the tightening tool. A tightening tool 10 shown in FIG. 1 includes a motor 13 serving as a drive source, which is housed in and fixed to a housing 11. The motor 13 is a brushless DC motor, and the mechanical inertial force (inertia) of the rotor is set to be small. A planetary gear mechanism 12 is connected to an output shaft of the motor 13. A rotary shaft 16 is connected to an output shaft of the planetary gear mechanism 12 via a clutch mechanism 14. The rotary shaft 16 is supported by a bearing device 18, and a bevel gear (not shown) is fixed to the tip end thereof. The bevel gear fixed to the rotary shaft 16 engages a bevel gear (not shown) fixed to a base end portion of a spindle 20. A socket (not shown) which engages with a head portion of a fastener (a bolt, nut, or screw etc.) is attached to the other end of the spindle 20.

In the tightening tool 10, when the motor 13 rotates, the rotation is reduced in speed by the planetary gear mechanism 12 and transmitted to the clutch mechanism 14. When a load acting on the spindle 20 (i.e. the output shaft 16) is low during an initial stage when tightening of the fastener has begun, the clutch mechanism 14 transmits the torque from the motor 13 to the spindle 20 as is. As a result, the spindle 20 rotates and the fastener is tightened accordingly. On the other hand, when the load acting on the spindle 20 (output shaft 16) increases as the fastener is tightened, the clutch mechanism 14 shuts off torque transmission from the motor 13 to the output shaft 16 (spindle 20), and as a result, tightening of the fastener is terminated.

Note that the tightening tool 10 includes a trigger switch SW for activating the motor 13. Further, a control unit 60 is housed in a handle portion 11*a* of the housing 11. Moreover, a battery pack 70 (shown in FIG. 5) for supplying a voltage to the motor 13 and so on is attached detachably to a lower end 11*b* of the housing 11.

Figure 2:
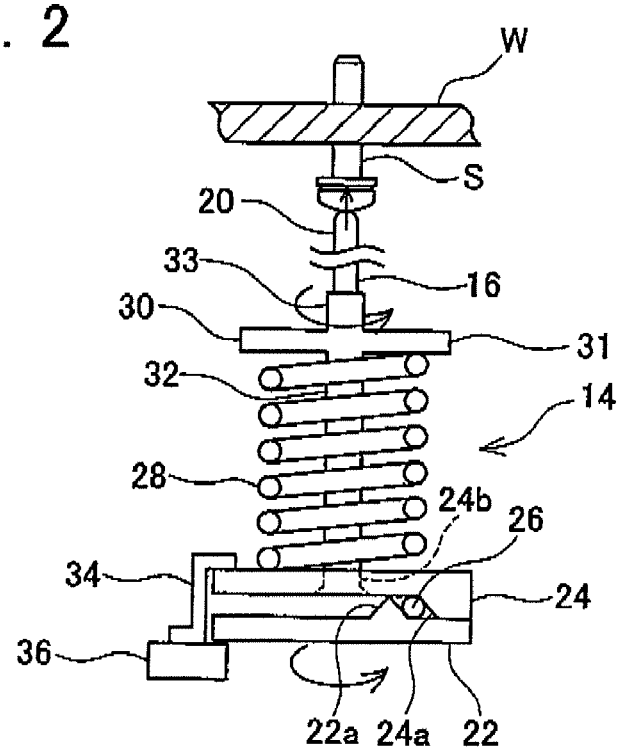
FIG. 2 is a diagram schematically showing the constitution of a clutch mechanism (during torque transmission).
Figure 3:
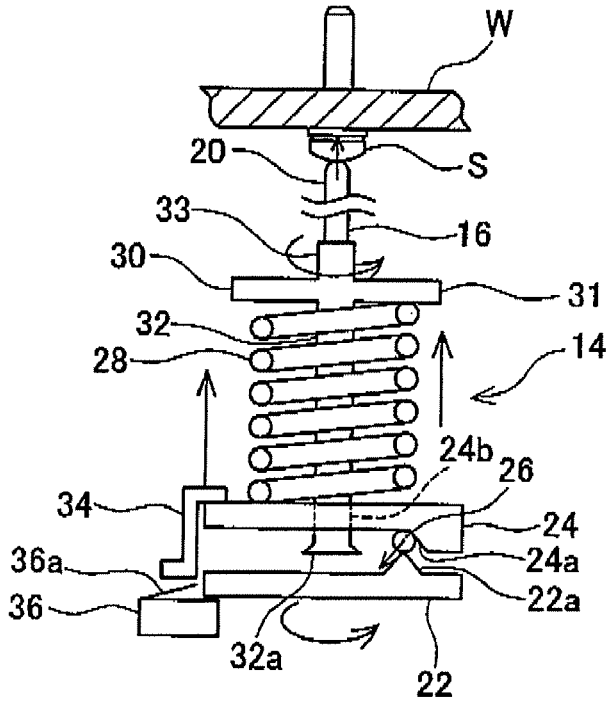
FIG. 3 is another diagram schematically showing the constitution of the clutch mechanism (when torque transmission is shut off).

The aforementioned clutch mechanism 14 and bearing device 18 will now be described in detail. First, the clutch mechanism will be described with reference to FIGS. 2, 3. FIGS. 2, 3 are diagrams schematically showing the constitution of the clutch mechanism 14, FIG. 2 showing a state in which torque is transmitted by the clutch mechanism 14, and FIG. 3 showing a state in which torque transmission is shut off.

As shown in FIGS. 2, 3, the clutch mechanism 14 includes a pair of clutch plates 22, 24. The motor 13 (see FIG. 1) is connected to a lower surface of the clutch plate 22 via the planetary gear mechanism 12. A protrusion 22*a* is formed on the upper surface (the surface opposite the clutch plate 24 side) of the clutch plate 22. A protrusion 24*a* is also formed on the lower surface (the surface on the clutch plate 22 side) of the clutch plate 24. The protrusion 22*a* of the clutch plate 22 and the protrusion 24*a* of the clutch plate 24 engage with each other via a ball 26.

The rotary shaft 16 is connected to the clutch plate 24 via a pressing force adjustment member 30. The pressing force adjustment member 30 is constituted by a connecting rod 32 and a seat plate 31 provided on the upper end of the connecting rod 32. The connecting rod 32 is inserted into a through hole 24*b* formed in the clutch plate 24. The connecting rod 32 is capable of an axial advancing/retreating motion relative to the clutch plate 24, but incapable of axial rotation relative to the clutch plate 24. Hence, when the clutch plate 24 rotates, the connecting rod 32 (in other words, the pressing force adjustment member 30) also rotates. Note that a lower end 32*a* of the connecting rod 32 protrudes sideward (see FIG. 3) so that the connecting rod 32 does not become detached from the clutch plate 24.

The seat plate 31 is disposed in a position removed from the clutch plate 24 by a predetermined distance. The seat plate 31 is supported relative to the housing 11 so as to be incapable of moving in the axial direction of the connecting rod 32 and capable of rotation relative to the housing 11. An upwardly-protruding connecting portion 33 is formed on the upper surface of the seat plate 31. The rotary shaft 16 is fixed to the connecting portion 33. A compression spring 28 is interposed between the seat plate 31 and clutch plate 24 in a compressed state. Hence, the clutch plate 24 is biased in the direction of the clutch plate 22 (downward) by the compression spring 28. Note that the amount of compression of the compression spring 28 (i.e. the distance from the clutch plate 24 to the seat plate 31) is adjustable. By adjusting the compression amount of the compression spring 28, the biasing force which acts on the clutch plate 24 can be adjusted.

The actions of the clutch mechanism 14 will now be described. When the load required to tighten a screw S to a tightening member W (in other words, the load acting on the rotary shaft 16) is smaller than a predetermined value, the tip end of the protrusion 24*a* is caused to abut against the upper surface of the clutch plate 22 by the pressing force of the compression spring 28 such that the state of engagement between the protrusion 24*a* of the clutch plate 24 and the protrusion 22*a* of the clutch plate 22 is maintained (the state shown in FIG. 2). As a result, the torque transmitted to the clutch plate 22 from the motor 13 is transmitted to the clutch plate 24. Hence, the clutch plate 24 (i.e. the rotary shaft 16 and spindle 20) rotates and the screw S is tightened to the tightening member W.

On the other hand, when the load required to tighten the screw S to the tightening member W reaches or exceeds the predetermined value, the clutch plate 24 moves upward against the pressing force of the compression spring 28. As a result, the protrusion 24*a* of the clutch plate 24 passes over the protrusion 22*a* of the clutch plate 22 such that the state of engagement between the clutch plate 24 and the clutch plate 22 is released (the state shown in FIG. 3). As a result, torque transmission from the clutch plate 22 to the clutch plate 24 is shut off, and tightening of the screw S to the tightening member W is halted.

As is evident from the above description, the tightening torque of the screw S is the load of the rotary shaft 16 when the clutch mechanism 14 is activated, and the load of the rotary shaft 16 upon activation of the clutch mechanism 14 is determined according to the pressing force of the compression spring 28 (in other words, according to an initial compression amount of the compression spring 28). The initial compression amount of the compression spring 28 (the interval between the clutch plate 24 and the seat plate 31) is adjustable, and therefore the tightening tool 10 of this embodiment is capable of adjusting the tightening torque of the screw S to a desired value.

Note that a clutch activation detection device is disposed in the vicinity of the clutch plates 22, 24. The clutch activation detection device detects that torque transmission from the clutch plate 22 to the clutch plate 24 has been shut off. The clutch activation detection device is constituted by a detection switch 36 and a transmission member 34. The upper end of the transmission member 34 abuts against the upper surface of the clutch plate 24. The lower end of the transmission member 34 abuts against the detection switch 36 when the clutch plate 24 and the clutch plate 22 are engaged (in the state shown in FIG. 2). When the state of engagement between the clutch plate 24 and the clutch plate 22 is released (the state shown in FIG. 3), the transmission member 34 moves upward together with the clutch plate 22. As a result, a movable piece 36*a* of the detection switch 36 moves away from the detection switch 36, and thus the clutch activation detection device detects that torque transmission has been shut off.

Figure 4:
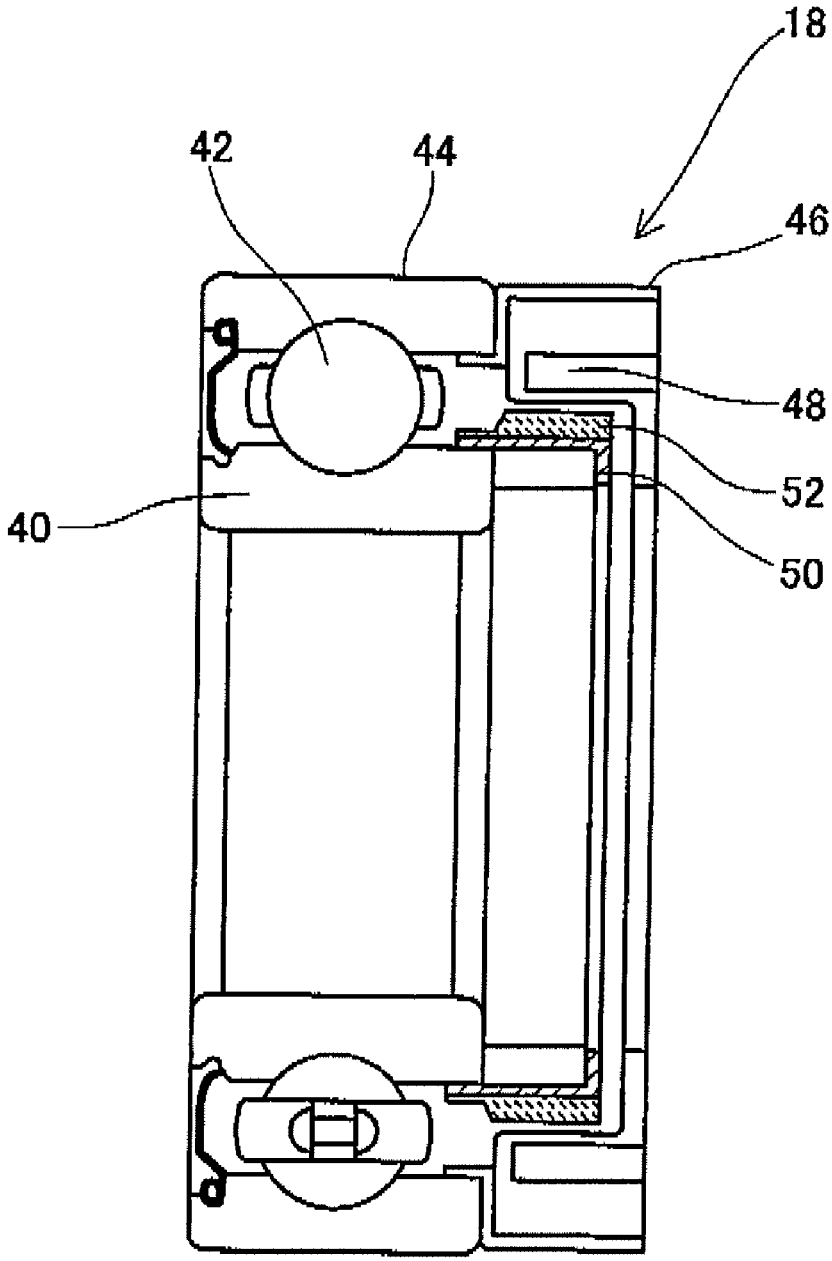
FIG. 4 is a sectional view of a bearing device.

Next, the bearing device 18 will be described with reference to FIG. 4. FIG. 4 is a sectional view showing the structure of the bearing device. As shown in FIG. 4, the bearing device 18 includes an inner cylinder 40 and an outer cylinder 44. A ball 42 is interposed between the inner cylinder 40 and outer cylinder 44, and the inner cylinder 40 is mounted to be capable of rotation relative to the outer cylinder 44. The outer cylinder 44 is housed in and fixed to the housing 11, and the inner cylinder 40 is supported so as to be capable of rotation relative to the outer cylinder 44 (i.e. the housing 11).

A through hole having a substantially identical diameter to the outer diameter of the rotary shaft 16 (a slightly smaller diameter than the outer diameter of the rotary shaft 16) is formed in the inner cylinder 40. The rotary shaft 16 is forcibly inserted into this trough hole from the right end side of the drawing, and thus the inner cylinder 40 is fixed to the rotary shaft 16. Hence, when the rotary shaft 16 rotates, the inner cylinder 40 rotates integrally with the rotary shaft 16.

A cylindrical magnet attaching member 50 is fixed to the right end of the inner cylinder 40 in the drawing. A plurality of magnets 52 is disposed at equal intervals on the outer peripheral surface of the magnet attaching member 50. The magnets 52 are constituted by a magnet in which the South pole is on the outer peripheral side and a magnet in which the North pole is on the outer peripheral side, and these magnets are disposed alternately.

A cylindrical sensor attaching member 46 is fixed to the right end of the outer cylinder 44 in the drawing. A rotation angle detection sensor 48 is disposed in a location opposing the magnets 52 on the inner wall surface of the sensor attaching member 46. The rotation angle detection sensor 48 is a latch type Hall IC which detects magnetic field variation and switches the state of an output signal. The output signal of the rotation angle detection sensor 48 shifts to a LOW level when a magnetic field on the South pole side is activated, and shifts to a HIGH level when a magnetic field on the North pole side is activated.

Hence, when the rotary shaft 16 rotates such that the magnet 52 whose South pole side is on the outer peripheral side is positioned in a position opposing the rotation angle detection sensor 48, the output signal of the rotation angle detection sensor 48 shifts to the LOW level, and when the magnet 52 whose North pole side is on the outer peripheral side is positioned in this position, the output signal of the rotation angle detection sensor 48 shifts to the HIGH level. Thus, a pulse signal is output from the rotation angle detection sensor 48 in accordance with the rotation of the rotary shaft 16, and by counting the number of pulse signals, the rotation angle of the rotary shaft 16 can be detected.

Figure 5:
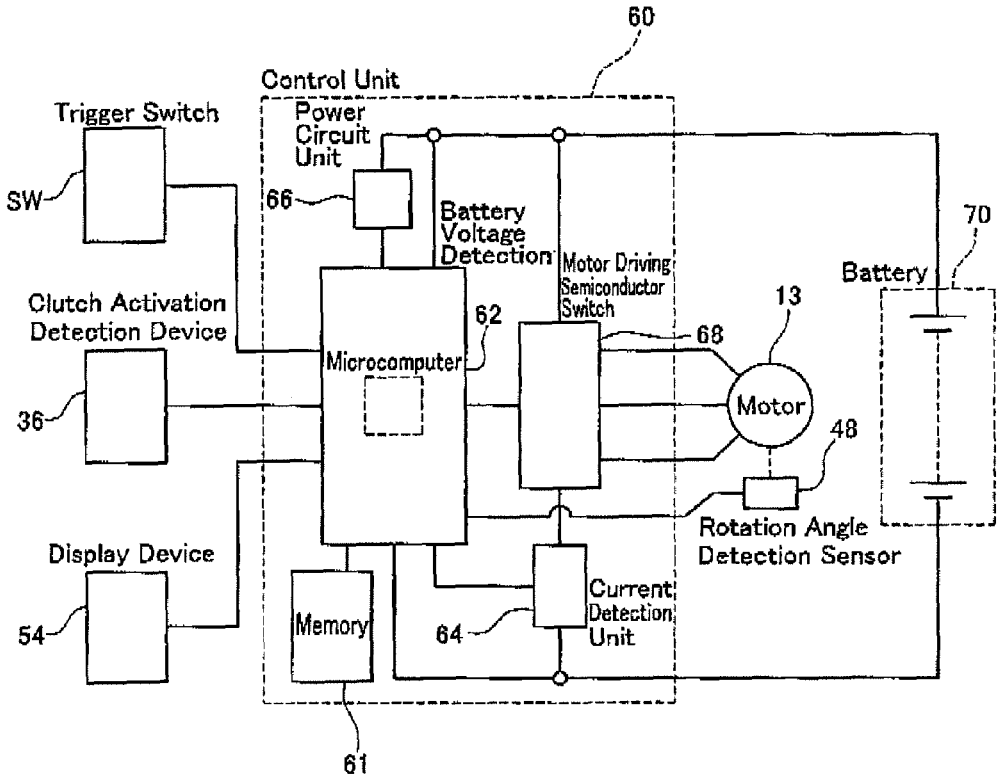
FIG. 5 is a block diagram showing a control constitution of the tightening tool of this embodiment.

Next, referring to FIG. 5, the constitution of the control unit 60 will be described. As shown in FIG. 5, the control unit 60 includes a microcomputer 62. The microcomputer 62 comprises a CPU, a ROM, a RAM, and an I/O, and these are integrated on a single chip. The ROM of the microcomputer 62 stores a control program to be described below for automatically halting driving of the motor 13 and determining whether or not the tightening torque is normal, and so on. The control unit 60 further includes a memory 61 (for example, a non-volatile memory such as an EEPROM) in addition to the microcomputer 62. The memory 61 stores a preset range of a motor current and/or a preset angle range of a main shaft rotation angle.

The aforementioned trigger switch SW, detection switch 36 (clutch activation detection device), and rotation angle detection sensor 48 are connected to the microcomputer 62, and signals from the trigger switch SW, detection switch 36, and rotation angle detection sensor 48 are input into the microcomputer 62.

A display device 54 is also connected to the microcomputer 62. The display device 54 is constituted by an LED or the like, and notifies an operator of whether or not the tightening torque is normal. The display device 54 may be constituted by two color LEDs (a red LED and a green LED), for example. When the tightening torque is normal, the green LED is illuminated, and when the tightening torque is abnormal, the red LED is illuminated. Note that the display device 54 is housed within the housing 11 and can be seen by the operator through a display window (not shown in FIG. 1) formed in the housing 11.

A battery 70 is connected to the microcomputer 62 via a power circuit unit 66. The power from the battery 70 is converted into power for the microcomputer 62 by the power circuit unit 66, and supplied to the microcomputer 62. Note that an output from the battery 70 is input separately into the microcomputer 62. By means of this input, the microcomputer 62 detects the output voltage of the battery 70 and thereby detects the remaining capacity of the battery 70.

Further, the battery 70 is connected to the motor 13 via a motor driving semiconductor switch 68. The semiconductor switch 68 is PWM-controlled by the microcomputer 62 to convert a direct current from the battery 70 into a three-phase current. The three-phase current converted by the semiconductor switch 68 is supplied to the motor 13 to rotate the motor 13. Note that the semiconductor switch 68 is connected to the negative pole of the battery 70 via a current detection unit 64. The current detection unit 64 detects the current flowing to the semiconductor switch 68 (in other words, the current flowing to the motor 13 via the semiconductor switch 68). A current value detected by the current detection unit 64 is input into the microcomputer 62.

Processing executed by the microcomputer 62 when the screw S is tightened to the tightening member W will now be described with reference to the flowchart shown in FIG. 6.

Figure 6:
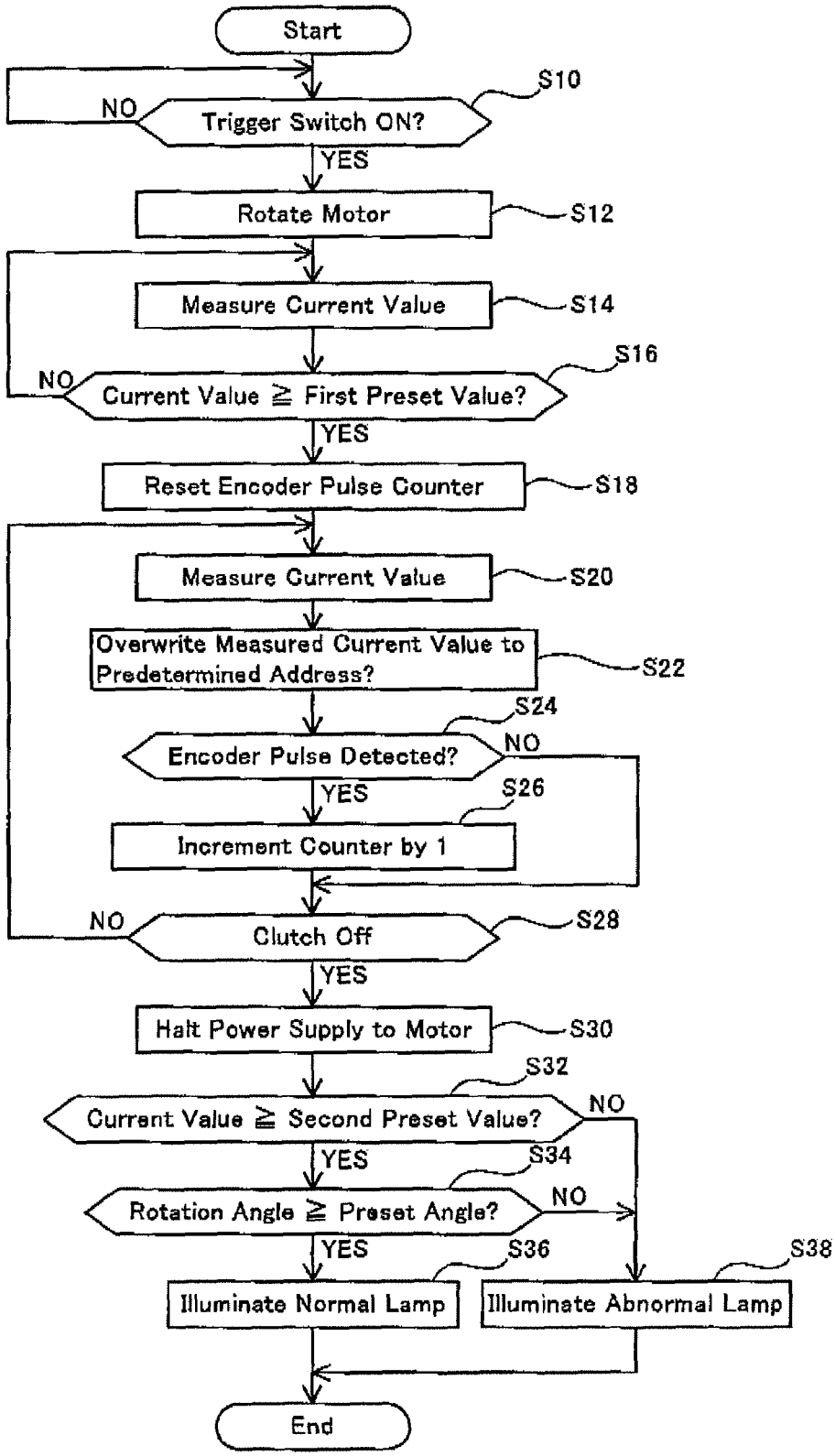
FIG. 6 is a flowchart showing processing performed by a microcomputer.

As shown in FIG. 6, first the microcomputer 62 determines whether or not the trigger switch SW is ON (S10). When the trigger switch SW is ON, the microcomputer 62 advances to a step S12, and when the trigger switch SW is not ON, the microcomputer 62 waits until the trigger switch SW is switched ON.

Having advanced to the step S12, the microcomputer 62 begins rotating the motor 13, and then measures the value of the current flowing to the motor 13 on the basis of the output from the current detection unit 64 (S14). Next, the microcomputer 62 determines whether or not the motor current value measured in the step S14 is equal to or greater than a first preset value (S16). The term "first preset value" denotes a value which is set to determine whether or not the screw S is seated on the tightening member W.

When the measured motor current value is less than the first preset value (NO in the step S16), the microcomputer 62 determines that the screw S is not seated on the tightening member W and returns to the step S14 to repeat the processing from the step S14. Conversely, when the measured motor current value is equal to or greater than the first preset value (YES in the step S16), the microcomputer 62 determines that the screw S is seated on the tightening member W and advances to the step S18.

In the step S18, the microcomputer 62 resets a counter for counting the pulse count of the detection signals (encoder signals) from the rotation angle detection sensor 48. The microcomputer 62 then measures the value of the current flowing to the motor 13 (S20), and overwrites the measured current value to a predetermined address of the RAM in the microcomputer 62 (S22).

In a step S24, the microcomputer 62 determines whether or not a detection signal (pulse wave) from the rotation angle detection sensor 48 has been detected. When a pulse wave has been detected (YES in the step S24), the microcomputer 62 increments the value of the counter by 1 (S26), and when no pulse wave is detected (NO in the step S24), the microcomputer 62 skips the step S26.

In a step S28, the microcomputer 62 determines whether or not the clutch mechanism 14 has been activated (i.e. whether or not torque transmission from the motor 13 to the rotary shaft 16 has been shut off) on the basis of the detection signal from the detection switch 36. When the clutch mechanism 14 has not been activated (NO in the step S28), the microcomputer 62 returns to the step S20 and repeats the processing from the step S20. Hence, a motor current value is overwritten to the RAM of the microcomputer 62 every time the processing is performed, and the counter value is increased on the basis of the detection signals from the rotation angle detection sensor 48.

When the clutch mechanism 14 has been activated (YES in the step S28), first the microcomputer 62 halts the supply of power to the motor 13 (S30). Next, the microcomputer 62 determines whether or not the current value stored in the RAM of thereof (in other words, the current value at the time of activation of the clutch mechanism 14) is equal to or greater than a second preset value (S32). When the current value at the time of clutch mechanism activation is equal to or greater than the second preset value (YES in the step S32), the microcomputer 62 tentatively determines that the screw S has been tightened at a predetermined tightening torque, and advances to a step S34. Conversely, when the current value at the time of clutch mechanism activation is less than the second preset value (NO in the step S32), the microcomputer 62 determines that the clutch mechanism 14 was activated before the screw S reached the preset tightening torque, and advances to a step S38.

In the step S34, the microcomputer 62 determines whether or not the value of the counter which counts the pulse waves of the detection signals output from the rotation angle detection sensor 48, or in other words the rotation angle of the rotary shaft 16 (the rotation angle of the screw S) is equal to or greater than a preset angle. When the rotation angle of the rotary shaft 16 is equal to or greater than the preset angle (YES in the step S34), the microcomputer 62 determines that the screw S has been tightened at the predetermined tightening torque, and displays a message to that effect on the display device (S36). If, on the other hand, the rotation angle of the rotary shaft 16 is less than the preset angle (NO in the step S34), the microcomputer 62 determines that the screw S has not been tightened at the predetermined tightening torque and advances to the step S38. In the step S38, the microcomputer 62 displays a message indicating that the screw S has not been tightened at the predetermined tightening torque on the display device 54.

Figure 7:
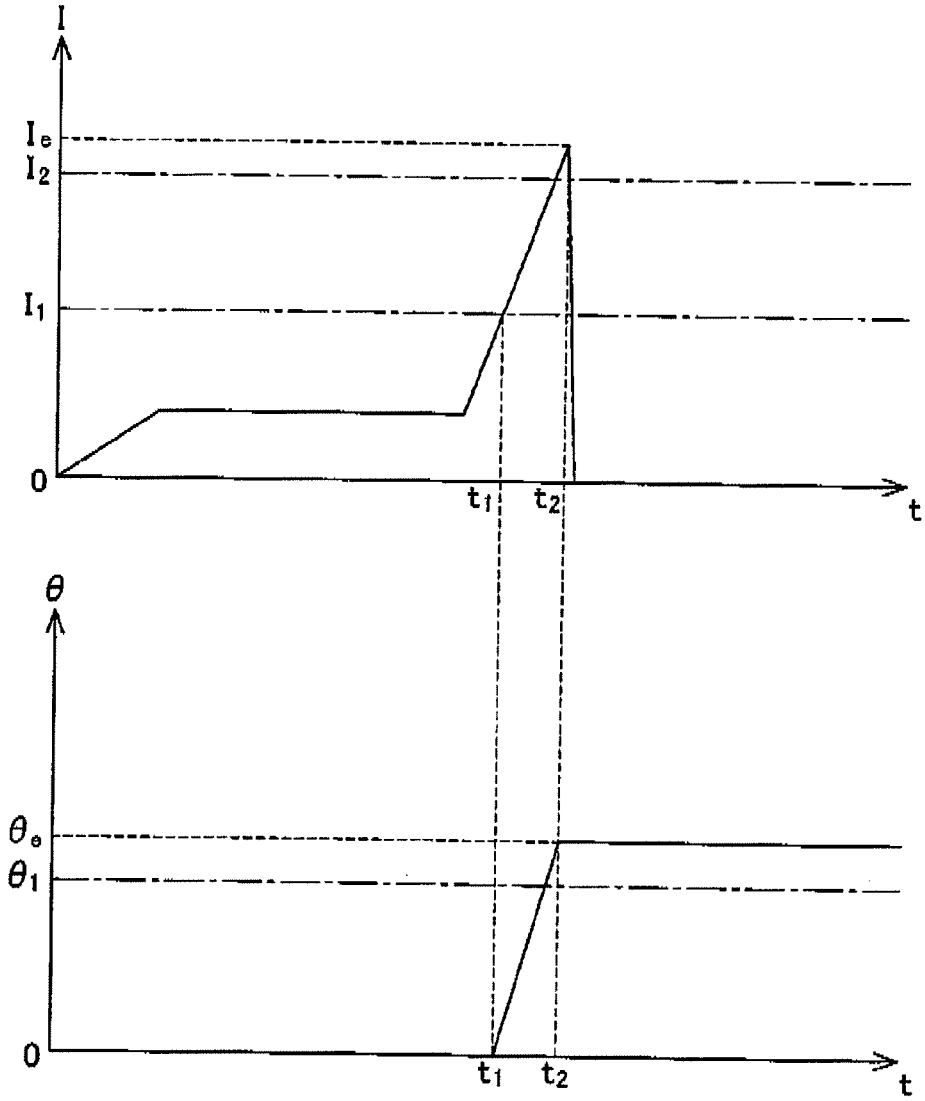
FIG. 7 is a view showing temporal variation in a motor current when a screw is tightened by the tightening tool of this embodiment, together with temporal variation in the rotation angle of the screw.

The processing of the microcomputer 62 will now be described specifically with reference to FIG. 7. When the trigger switch SW is switched ON, the microcomputer 62 drives the motor 13 to rotate and measures the value of the current flowing to the motor 13 (the graph at the top of FIG. 7). When the measured motor current value equals or exceeds a first preset value $I_1$, detection of the rotation angle of the rotary shaft 16 (the screw S) begins (the graph at the bottom of FIG. 7). When a motor current value Ie upon activation of the clutch mechanism 14 is equal to or greater than the second preset value $I_2$ ($I_2>I_1$) and a rotation angle θe of the rotary shaft 16, detected during the period extending from the time at which the motor current value equals or exceeds the first preset value $I_1$ to the time at which the clutch mechanism 14 is activated, equals or exceeds a preset angle $\theta_1$, it is determined that the screw S has been tightened at the predetermined tightening torque. Conversely, when the motor current value Ie fills below the second preset value $I_2$ or the rotation angle θe falls below the preset angle $\theta_1$, it is determined that the screw S has not been tightened at the predetermined tightening torque.

As is clear from the above description, the tightening tool 10 of this embodiment determines whether or not the tightening torque of the screw S corresponds to the predetermined tightening torque on the basis of the motor current value at the time of activation of the clutch mechanism 14 and the rotation angle of the screw S after the motor current value has reached or exceeded the first preset value. In other words, the motor current value correlates with the tightening torque of the screw S, and the rotation angle of the screw S after the motor current value has reached or exceeded the first preset value (i.e. the rotation angle of the screw S when the screw S is seated on the tightening member W) correlates with the tightening torque of the screw S. Hence, a determination is made from these values as to whether or not the tightening torque of the screw S is normal, and the operator is notified of the determination result. As a result, the operator is able to respond speedily to the operation result displayed on the display device 54.

Further, in the tightening tool 10 of this embodiment, a brushless DC motor is used as the motor 13, enabling a reduction in rotor inertia so that the effect of rotor inertia on the detected motor current value and rotation angle of the screw S is reduced. As a result, the tightening torque of the screw S can be determined with precision on the basis of the motor current value and the rotation angle of the screw S.

Note that the "second preset value (a threshold which is compared to the motor current value upon activation of the clutch mechanism)" for determining whether or not the tightening torque of the screw S is normal varies according to the screw type and the tightening member W to which the screw is tightened. For example, when the type of the screw S differs, the correct tightening torque thereof varies, and hence the second preset value varies. When the screw type is identical, the correct tightening torque remains the same, but when the tightening member W is different, the second preset value varies. Hence, the "second preset value" is preferably set appropriately in accordance with the screw and tightening member combination (in other words, the operation type). Therefore, the user of the tightening tool 10 preferably performs clutch adjustment (adjustment (mechanical adjustment) of the spring load) and setting of the "second preset value" in accordance with the actual tightening location (note that the "second preset value" set by the user may be stored in the memory 61).

Figure 8:
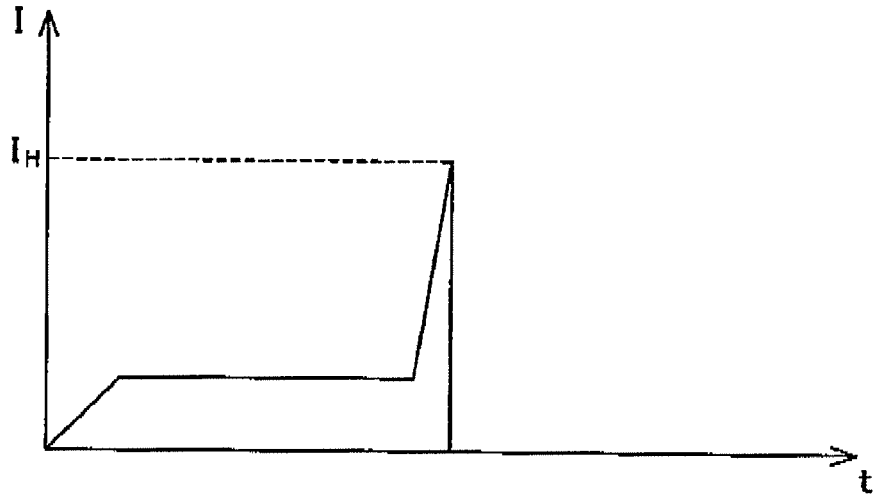
FIG. 8 is a view showing temporal variation in the motor current when the same screw is tightened to various different types of tightening members at the same tightening torque.
Figure 8:
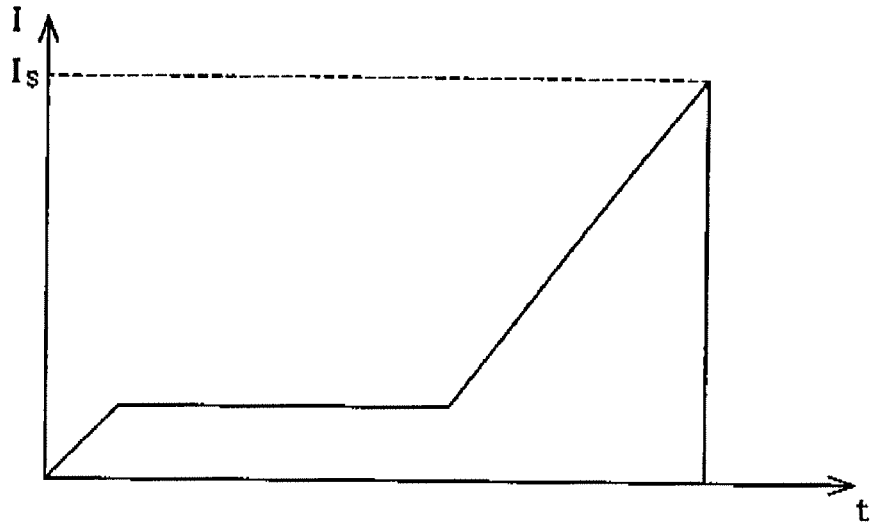

For example, FIG. 8 shows patterns of variation in the motor current value when an identical screw is tightened at an identical tightening torque into different types of tightening member W. FIG. 8A shows temporal variation in the motor current value when the screw is tightened to a hard joint material (iron or the like, for example), while FIG. 8B shows temporal variation in the motor current value when the screw is tightened to a soft joint material (wood or the like, for example).

As is clear from FIG. 8, when the screw is tightened to a hard joint material, the current increase rate is large once the screw is seated, but a motor current value $I_H$ upon clutch activation decreases. On the other hand, when the screw is tightened to a soft joint material, the current increase rate is small once the screw is seated, but a motor current value $I_S$ ($I_S>I_H$) upon clutch activation increases. Hence, the "second preset value" when the screw is tightened to a hard joint material is set to be slightly lower than the "second preset value" when the screw is tightened to a soft joint material.

Note that by lowering the motor rotation speed and reducing the gear ratio of the planetary gear, the effect of motor inertia can be reduced dramatically. By reducing the effect of motor inertia, the difference between $I_H$ and $I_S$ can be reduced ($I_H \approx I_S$), and the two values can easily be made identical.

Further, when a tightening operation is performed on an identical line, at an identical target torque, and with different tightening members, the "second preset value" can be stored in the memory 61 for each type of tightening member, and the "second preset value" can be modified in accordance with the tightening member type. According to this constitution, an appropriate determination can be made in accordance with the tightening member type.

In this case, the "second preset value" may be modified by having the operator manipulate a switch provided on the tightening tool, or the type of tightening member may be determined by the microcomputer 62 and the "second preset value" modified accordingly. For example, a pattern of temporal variation in the motor current value is stored in the memory 61 for each type of tightening member. The microcomputer 62 may then specify the type of tightening member from the temporal variation patterns stored in the memory 61 and temporal variation in the motor current value measured during the tightening operation. For example, the tightening member type may be determined based upon the magnitude of the current increase rate of the motor current value once the screw is seated (see FIG. 8).

Alternatively, the tightening member type may be determined based upon the rate of change in the rotation angle of the screw once the screw is seated. More specifically, variation in the rotation angle of the screw once the screw is seated when the screw is tightened to a hard joint material is smaller than the variation when the screw is tightened to a soft joint material. This difference may be used to specify the type of tightening member.

Similarly to the "second preset value" described above, the "preset angle (a threshold compared to the measured rotation angle of the screw)" and the "first preset value" vary according to the screw type and the type of the tightening member W to which the screw is tightened. Hence, these values are also preferably set for each operation type. For example, the rotation angle of the screw once the screw is seated when the screw is tightened to a hard joint material is smaller than the rotation angle of the screw is seated when the screw is tightened to a soft joint material. Accordingly, the "preset angle" when the screw is tightened to a hard joint material is set to a smaller value than the "preset angle" when the screw is tightened to a soft joint material.

Several preferred embodiments of the present invention were described in detail above, but these are merely examples of the present invention, and do not limit the scope of the claims. The technology described in the claims includes various alterations and modifications of the specific examples described above.

Figure 9:
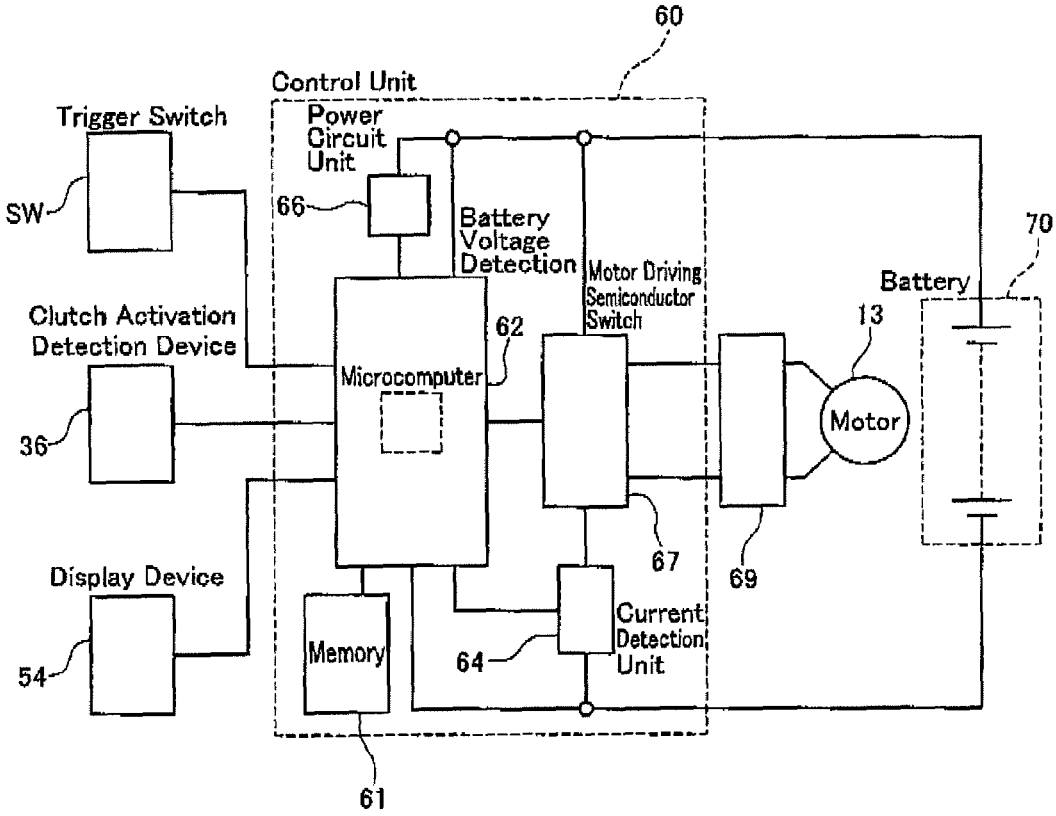
FIG. 9 is a block diagram showing the constitution of a control system of a tightening tool according to another embodiment of the present invention.

For example, in the embodiment described above, a brushless DC motor is used as the motor 13, but a permanent magnet brush motor (for example, a brush DC motor) may be used as the motor of the tightening tool. FIG. 9 shows the control constitution of the tightening tool when a brush DC motor is used. As is clear from FIG. 9, the rotation angle detection sensor for detecting the rotation angle of the rotary shaft is not provided in this tightening tool, and the determination as to whether the tightening torque is normal or not is made according to the motor current value upon clutch activation alone.

Figure 10:
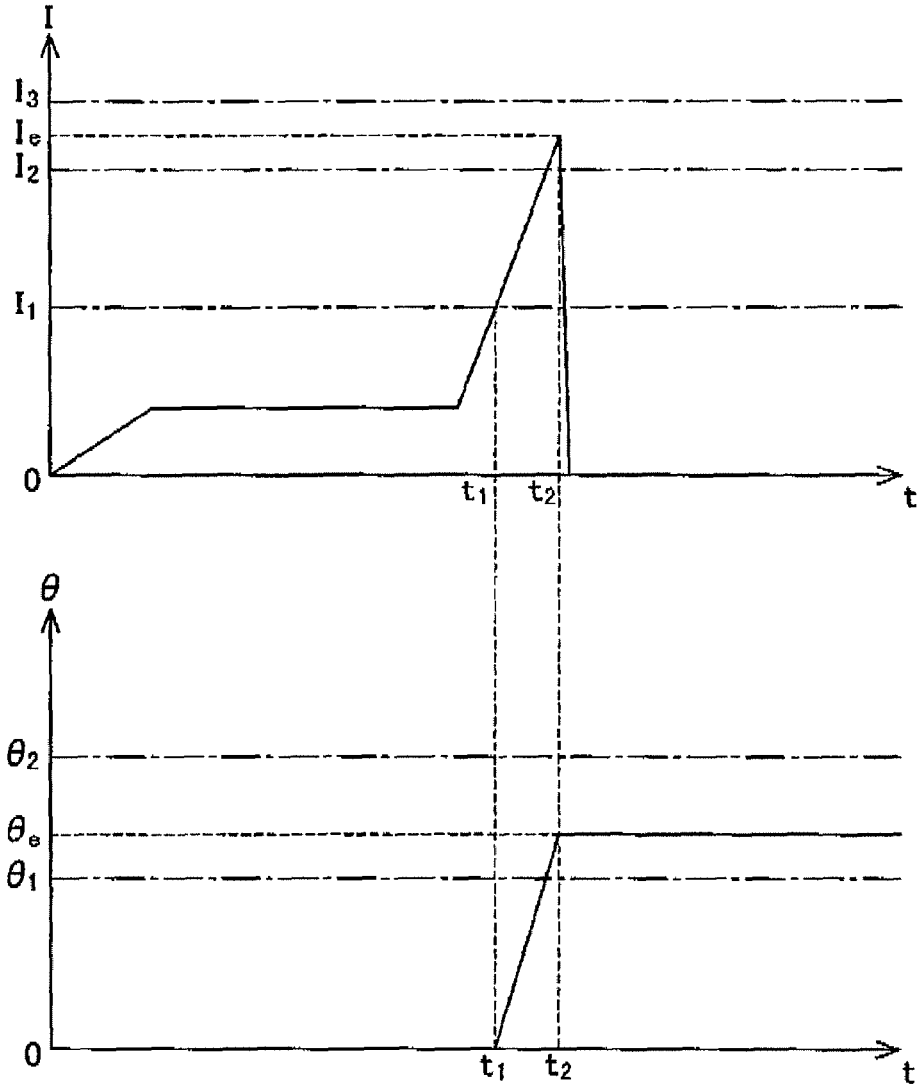
FIG. 10 is a view illustrating a modified example of this embodiment.

Further, in the embodiment described above, the determination as to whether the tightening torque is normal or not is made by comparing the motor current value when torque transmission is shut off with the "second preset value", and comparing the measured rotation angle of the rotary shaft with the "preset angle". However, the present invention is not limited to this aspect, and as shown in FIG. 10, for example, the determination as to whether the tightening torque of the screw is normal or not may be made according to whether or not the measured motor current Ie upon torque transmission shut-off is within a "preset range ($I_2$ to $I_3$)", or whether or not the measured rotation angle θe of the rotary shaft is within a "preset angle range ($\theta_1$ to $\theta_2$)". In so doing, irregular situations in which the tightening torque of the screw increases beyond a predetermined value for some reason or the like can be detected.

Further, in the embodiment described above, variation in the rotation angle of the screw S is detected by the bearing device 18 supporting the rotary shaft 16. However, variation in the rotation angle of the screw S may be detected by detecting variation in the rotation angle of the motor (more precisely, the rotor) using a motor including an encoder.

Figure 11:
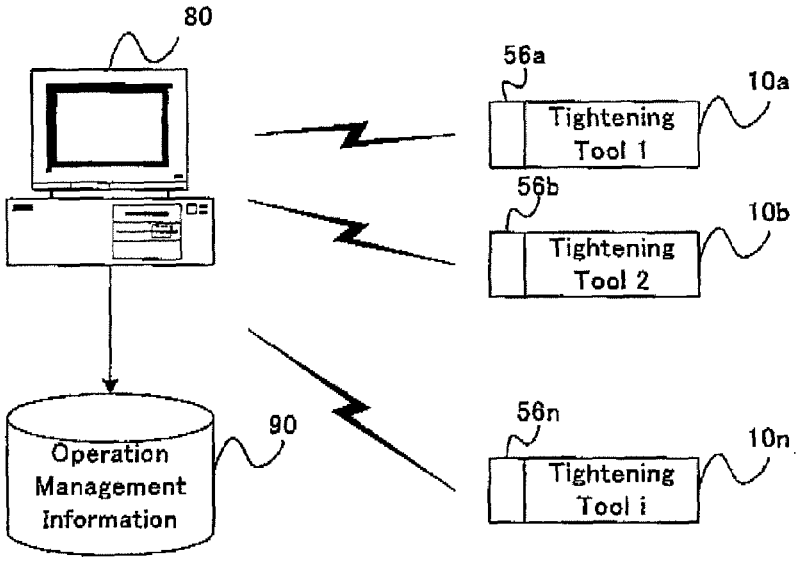
FIG. 11 is a schematic diagram of a management system according to an embodiment of the present invention.

Further, a communication function may be added to the tightening tool, and the tightening torque may be managed by a management apparatus connected communicably to the tightening tool. FIG. 11 is a schematic diagram of a management system according to an embodiment of the present invention, and FIG. 12 is a block diagram showing the constitution of the management apparatus.

As shown in FIG. 11, tightening tools 10*a*, 10*b*, . . . , 10*n* include communication devices 56*a*, 56*b*, . . . , 56*n*, respectively. The communication devices 56*a*, 56*b*, . . . , 56*n* are connected to a microcomputer (see FIG. 5) of each tightening tool 10*a*, 10*b*, . . . , 10*n* and controlled by the microcomputer.

A management apparatus 80 is constituted by a personal computer or the like, and connected communicably to the tightening tools 10*a*, 10*b*, . . . , 10*n*. An external storage device 90 is connected to the management apparatus 80. Operation management information for each of the tightening tools 10*a*, 10*b*, . . . , 10*n* is stored in the external storage device 90.

Figure 12:
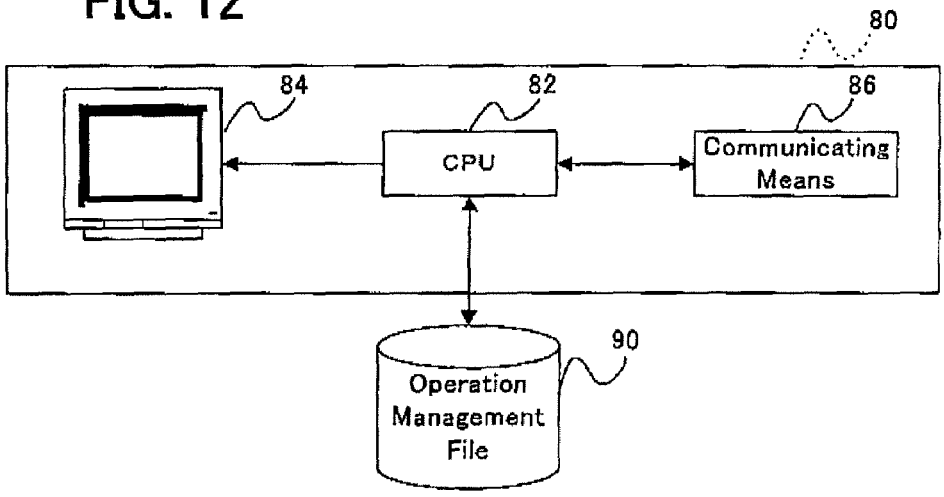
FIG. 12 is a block diagram showing the constitution of a management apparatus in the management system shown in FIG. 11.

As shown in FIG. 12, the management apparatus 80 includes a communication device 86 which communicates with the communication devices 56*a*, 56*b*, . . . , 56*n* of the tightening tools 10*a*, 10*b*, . . . , 10*n*, a monitor 84 which displays various information, a CPU 82 connected to the communication device 86 and monitor 84. The CPU 82 performs processing to receive operation management information transmitted from the tightening tools 10*a*, 10*b*, . . . , 10*n*, store the received operation management information in the external storage device 90, and so on.

In this management system, every time a tightening operation is performed, the tightening tools 10*a*, 10*b*, . . . , 10*n* transmit operation management information relating to the tightening operation to the management apparatus 80. The transmitted operation management information includes information as to whether or not the tightening torque of the tightening operation is normal, the motor current value upon clutch activation, the rotation angle of the rotary shaft, an ID number of the tightening tool, and specifying information for specifying the fastener to be tightened in the tightening operation (for example, the operation completion time and so on).

Upon reception of the operation management information from the tightening tools 10*a*, 10*b*, . . . , 10*n*, the management apparatus 80 stores the received operation management information in the external storage device 90. The external storage device 90 stores operation results (for example, whether the tightening torque is normal or abnormal, the motor current value upon clutch activation, the rotation angle of the rotary shaft, and so on) for each tightening tool (i.e. for each tightening tool ID number) and specifying information (the operation completion time and so on).

The CPU 82 of the management apparatus 80 determines whether or not the tightening tools require maintenance from temporal variation in the operation management information (in particular, the motor current value upon clutch activation and the rotation angle of the rotary shaft) stored in the external storage device 90. When it is determined that a tightening tool requires maintenance, a message to that effect is displayed on the monitor 84. The monitor 84 displays the message indicating that maintenance is required, the ID number of the tightening tool, and so on, for example.

The CPU 82 may also predict the maintenance timing of the tightening tools 10*a*, 10*b*, . . . , 10*n* from temporal variation in the operation management information (the motor current value upon clutch activation and the rotation angle of the rotary shaft) and display the predicted maintenance ting on the monitor 84. An operation manager can then view the predicted maintenance timing displayed on the monitor 84 of the management apparatus 80 prior to the beginning of the operation and determine based upon the predicted maintenance timing whether or not to use the tightening tool. For example, in the case of a tightening tool used on a factory assembly line, the maximum number of tightening operations per day is known in advance. Hence, the maintenance timing can be predicted before the beginning of an operation, and when the predicted maintenance truing arrives during the operation, a determination can be made to halt use of the tightening tool.

According to the management system described above, the number of tightening operations performed by each tightening tool, temporal variation in the motor current value, temporal variation in the rotation angle of the rotary shaft, and so on can be specified. From this information, the need for maintenance of the tightening tool can be determined.

Furthermore, when the tightening torque is abnormal, the fastener relating to the tightening operation can be narrowed down from the ID number of the tightening tool and the specifying information (operation completion time) thereof. For example, an operator is specified from the ID number of the tightening tool, and the content of the assembly line operation is specified from the specified operator. From the operation completion time, the products moving along the production line can be narrowed down. By narrowing down the operation content and the product, the range of fastener having the abnormal tightening torque can be narrowed down, and hence measures such as retightening can be taken efficiently.

Note that in the management system described above, operation management information is transmitted to the management apparatus for each tightening operation. However, the present invention is not limited to this aspect. For example, operation management information relating to the tightening operations implemented within a fixed time period may be stored together in the memory of the tightening tool and then transmitted together to the management apparatus. For example, at the start of a day's operation, an operator is registered in the management apparatus for each tightening tool. At the end of the day's operation, the operation management information relating to the tightening operations performed during the day may be transmitted together to the management apparatus.

The technical elements described in the specification or drawings exhibit technical usefulness individually and in various combinations, and are not limited to the combinations described in the claims at the time of filing. Further, the technology described in the specification or drawings achieves a plurality of objects simultaneously, and technical usefulness is attained simply through the achievement of any one of these objects.

The invention claimed is:

1. A tightening tool for tightening a fastener, comprising:

a motor;

a main shaft which engages with the fastener;

a clutch disposed between the motor and the main shaft, wherein the clutch rotates the main shaft by transmitting torque from the motor to the main shaft when a load acting on the main shaft is less than a predetermined value, and shuts off torque transmission from the motor to the main shaft when the load acting on the main shaft reaches or exceeds the predetermined value;

means for detecting a current flowing to the motor; and means for determining, when torque transmission from the motor to the main shaft has been shut off, whether or not a tightening torque of the fastener is normal based upon a motor current value detected by the current detecting means at the time of torque transmission shut-off.

2. A tightening tool according to claim 1, wherein the determining means determines that the tightening torque of the fastener is normal when the detected motor current value is within a preset range, and determines that the tightening torque of the fastener is abnormal when the detected current value is outside of the preset range.

3. A tightening tool according to claim 2, further comprising a memory which stores a preset range for each type of tightening operation, wherein the determining means reads a preset range from the memory in accordance with the type of tightening operation, and determines whether or not the tightening torque is normal on the basis of the read preset range.

4. A tightening tool according to claim 3, further comprising means for detecting a rotation angle of the main shaft or the motor, wherein the determining means further determines whether or not a tightening torque of the fastener is normal based upon the rotation angle of the main shaft or the motor detected by the rotation angle detecting means during a period extending from (1) a time at which a current value detected by the current detecting means exceeds a preset value to (2) a time at which torque transmission from the motor to the main shaft is shut off.

5. A tightening tool according to claim 4, wherein the determining means (a) measures the rotation angle of the main shaft or the motor from the time at which the current flowing to the motor exceeds the preset value to a time at which the clutch is activated, and (b) determines that the tightening torque of the fastener is normal when the measured rotation angle is within a preset angle range and determines that the tightening torque of the fastener is abnormal when the measured rotation angle is outside of the preset angle range.

6. A tightening tool according to claim 5, further comprising a memory which stores a preset angle range for each type of tightening operation, wherein the determining means reads a preset angle range from the memory in accordance with the type of tightening operation, and determines whether or not the tightening torque is normal on the basis of the read preset angle range.

7. A tightening tool according to claim 6, wherein the determining means determines the operation type from temporal variation in the motor current value and/or temporal variation in the rotation angle of the main shaft after the current flowing to the motor has exceeded the preset value, and reads a preset angle range corresponding to the determined operation type.

8. A tightening tool according to claim 7, further comprising means for warning an operator when the tightening torque of the fastener is determined to be abnormal by the determining means.

9. A tightening tool for tightening a fastener, comprising:

a motor;

a main shaft which engages with the fastener;

a clutch disposed between the motor and the main shaft, wherein the clutch rotates the main shaft by transmitting torque from the motor to the main shaft when a load acting on the main shaft is less than a predetermined value, and shuts off torque transmission from the motor to the main shaft when the load acting on the main shaft reaches or exceeds the predetermined value;

an ammeter detecting a current flowing to the motor; and a microprocessor in communication with the ammeter, wherein the microprocessor determines that the tightening torque of the fastener is normal when a motor current value detected by the ammeter at a time of torque transmission shut-off is within a preset range, and determines that the tightening torque of the fastener is abnormal when a motor current value detected by the ammeter at a time of torque transmission shut-off is outside of the preset range.

10. A tightening tool according to claim 9, wherein the clutch comprises a pair of clutch plates, and compression spring biasing one of the pair of clutch plates toward the other.

11. A tightening tool according to claim 10, further comprising a sensor adapted to detect that the clutch has been activated, wherein the microprocessor determines whether or not the clutch has shut off torque transmission based upon an output from the sensor.

12. A tightening tool according to claim 11, wherein the microprocessor obtains the motor current value from an output of the ammeter when the microprocessor determines that the clutch has been activated.

13. A tightening tool according to claim 9, further comprising a memory which stores a preset range for each type of tightening operation, wherein the microprocessor reads a preset range from the memory in accordance with the type of tightening operation, and determines whether or not the tightening torque is normal on the basis of the read preset range.

14. A tightening tool according to claim 9, further comprising rotation angle sensor adapted to detect a rotation angle of the main shaft or the motor, wherein the microprocessor further determines whether or not a tightening torque of the fastener is normal based upon the rotation angle of the main shaft or the motor detected by the rotation angle sensor during a period extending from (1) a time at which a current value detected by the ammeter exceeds a preset value to (2) a time at which torque transmission from the motor to the main shaft is shut off.

15. A tightening tool according to claim 14, wherein the microprocessor (a) measures the rotation angle of the main shaft or the motor from the time at which the current flowing to the motor exceeds the preset value to a time at which the clutch is activated, and (b) determines that the tightening torque of the fastener is normal when the measured rotation angle is within a preset angle range and determines that the tightening torque of the fastener is abnormal when the measured rotation angle is outside of the preset angle range.

16. A tightening tool according to claim 15, further comprising a memory which stores a preset angle range for each type of tightening operation, wherein the microprocessor reads a preset angle range from the memory in accordance with the type of tightening operation, and determines whether or not the tightening torque is normal on the basis of the read preset angle range.

17. A tightening tool according to claim 16, wherein the microprocessor determines the operation type from temporal variation in the motor current value and/or temporal variation in the rotation angle of the main shaft after the current flowing to the motor has exceeded the preset value, and reads a preset angle range corresponding to the determined operation type.

18. A tightening tool according to claim 17, further comprising a display warning an operator when the tightening torque of the fastener is determined to be abnormal by the microprocessor.

* * * * *